US006513589B1

(12) United States Patent
Hansen et al.

(10) Patent No.: US 6,513,589 B1
(45) Date of Patent: Feb. 4, 2003

(54) HYDRAULIC SWITCH DEVICE

(75) Inventors: Henning Hansen, Randaberg (NO); Frode Kaland, Stavanger (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/806,698

(22) PCT Filed: Oct. 5, 1999

(86) PCT No.: PCT/NO99/00303

§ 371 (c)(1),
(2), (4) Date: Apr. 4, 2001

(87) PCT Pub. No.: WO00/20721

PCT Pub. Date: Apr. 13, 2000

(30) Foreign Application Priority Data

Oct. 5, 1998 (NO) ..... 19984646

(51) Int. Cl.[7] ..... E21B 23/01
(52) U.S. Cl. ..... 166/117.5; 166/117.6
(58) Field of Search ..... 166/117.5, 117.6, 166/250.01, 237, 241.6, 120

(56) References Cited

U.S. PATENT DOCUMENTS 3,814,182 A * 6/1974 Giroux ..... 166/226
3,969,937 A * 7/1976 Barrington et al. ..... 73/151
RE29,471 E * 11/1977 Giroux ..... 166/334
4,319,639 A * 3/1982 Mott ..... 166/377
4,321,965 A 3/1982 Restarick et al.
4,817,723 A * 4/1989 Ringgenberg ..... 166/321
4,848,463 A * 7/1989 Ringgenberg et al. ..... 166/250
5,103,902 A * 4/1992 Ross et al. ..... 166/120
5,535,767 A * 7/1996 Schnatzmeyer et al. ..... 137/1

FOREIGN PATENT DOCUMENTS

GB 2 213 514 A 8/1989
GB 2 248 465 A 4/1992

* cited by examiner

*Primary Examiner*—Frank S. Tsay
(74) *Attorney, Agent, or Firm*—Finnegan, Henderson, Farabow, Garrett & Dunner, L.L.P.

(57) ABSTRACT

A switch device (1) which sequentially conducts one hydraulic fluid stream (2) to two or more independently operated hydraulic units, where the switch device (1) with one or more channel throughputs (11, 12, 13 and 14) travels helically in a holding cylinder and transfers pressure streams in rotational sequence via fixed channels (8 and 8') in the holding cylinder to separately operated hydraulic devices. With activation and deactivation in succession with alternate pressure and pressure relief combined with corresponding spring device (4), the switch device (1) in the surrounding cylinder is simultaneously forced to perform a one-way helical and axial forward and backward movement, resulting in altered fluid communication. Full switch rotation is achieved with, for example, six equiangular waves, each at 60°, or with six different angular waves, such as 90°+60°+45°+60°+60°+45°.

2 Claims, 3 Drawing Sheets

HYDRAULIC SWITCH DEVICE

BACKGROUND OF THE INVENTION

The invention relates to a switch device for operation of a number of hydraulically operated units which are arranged in a bore hole, especially for exploration of hydrocarbons from a formation in the ground. The invention will, for example, permit surface control with one hydraulic fluid stream of a number of downhole, series-connected, individually controllable admission valves, which are integrated in a production tubing which extends down into the sea bed for use, for example, in zone-isolated, perforated and/or open production areas in an oil/gas well.

With present-day surface control of four independently operated downhole admission valves, for example, the four valves each have to be supplied with their own hydraulic control power through individual high pressure lines. This requires investment in and maintenance of expensive lines, which also have to be pulled in and coiled up on deck every time the production tubing is raised. The requirements for adequate throughway between the inner fluid-conducting pipe and the outer casing creates difficulties when lowering a plurality of such lines.

It is known that the pressure varies in the different production zones. This may be reflected in reduced production, where, for example, in a lower zone there is extremely high pressure, while the upper zone has lower pressure. The oil will then be able to travel in circular movements between the reservoir zones, with the result that it will not be extracted. The problem is solved by control/adjustment of the influx from the individual zones outside the casing.

It is further known that the different zones contain essentially different quantities of oil, gas and/or condensate, with the result that one or more zones successively produce increasing amounts of water as the zone is emptied. With current technology the oil and water-containing consistency from several zones is produced until the average proportion of mixture is approximately 90% water. At this stage the bore hole has to be closed as no longer profitable according to a cost/benefit evaluation.

If, for example, a well system is planned with six branches to six defined production zones, during the production period heterogeneous mixtures of oil/water will flow from these zones, which have been shown to produce more and more water.

SUMMARY OF THE INVENTION

The invention permits the total flow from the respective zones to be controlled by one hydraulic fluid stream from deck on the surface by activating one or more valves, which close one or more water-producing zones, with the added result that deposits of oil are forced into an adjacent advantageous zone. The zone or zones which produce undesirable amounts of water after prolonged production, and those zones which continue to produce acceptable oil concentrations are periodically registered.

By selectively shutting off the unacceptable water-producing zones in a well with, e.g., six branches, the likelihood of extending and thereby increasing the extraction of oil from a field is substantially improved. In extreme cases Be last zone of, e.g., six will product continuous amounts of oil far beyond the period when the five other zones have had to be closed. Estimates of this carried out by Rogalandsforskning amongst others indicate that the operating period of an oilfield can be extended from 3000 days to more than 5000 days, and with a progressively increasing volume.

If, for example, water injection is employed in surrounding geological formations, it will be possible to push the oil reservoirs towards the production zones in the area around the casing. If this reservoir control is employed together with the present invention, which permits regulated influx control, maximum exploitation will be achieved.

Mineral deposits which are deposited on the inside of the upstream pipe occur particularly when the water mixture in the oil reaches a certain level. The problem is reduced by facilities for controlling the water mixture, and the use of deposit-inhibiting chemical injections is also radically reduced, there being no need for such chemicals during a substantial part of the production phase.

Downhole pressure is typically around 350 bar, with a temperature of over/under 100° C. Vertical installation depth is usually from 900 to 8000 metres, while the measured extent may be up to 6000–16000 metres. The principles can also be used for $H_2S$ and $CO^2$ environments where the question of material choice becomes crucial for translating the principles into practical implementation.

A position meter or meters may also be inserted to indicate the degree of opening of the valve(s), thus giving the operator on the surface verification that the desired through-flow area has been achieved.

In order to obtain sequential co-operation of a number of, e.g., admission valves in the same well, an electro-hydraulic control system is currently employed, where an addressable solenoid valve only requires one fluid line from the control unit on the rig floor. The valves thus control the hydraulic power into respective valve chambers.

A method for addressing one hydraulic fluid stream by means of a sequential fluid-switching device to two or more independent or series-connected operated units, e.g. hydraulic admission valves or fluid switches, permits surface control of downhole series-connected, individually steplessly adjustable units, which are integrated in a fluid-producing pipe lowered in zone-isolated perforated and/or open production areas in an oil/gas well, without the use of lowered cables for electronic control.

In GB 2 213514 it is disclosed an apparatus for pressurized cleaning of flow conductors having a rotor which is movable relative to a cylinder by means of a zig-zag track of the and a lug of the above-mentioned type. The fluid which operates the rotor is the same fluid which flows in the suing and which is used for the cleaning purpose. No further hydraulic devices are operated by the fluid, In GB 2 248 465 it is disclosed a valve arrangement that enables the opening and closing of a test string circulation valve and a tubing isolating valve. These valves are operated directly and mechanically by the rotor. The fluid which flows in and around the string is the same fluid with which the rotor and therefore the valves are operated.

A purpose of the invention is to provide a switch device of the type mentioned in the introduction, with which a number of hydraulic devices may be operated independently of the well fluid which is transported in the bore hole and the string.

DETAILED DESCRIPTION OF THE INVENTION

Figure 1:
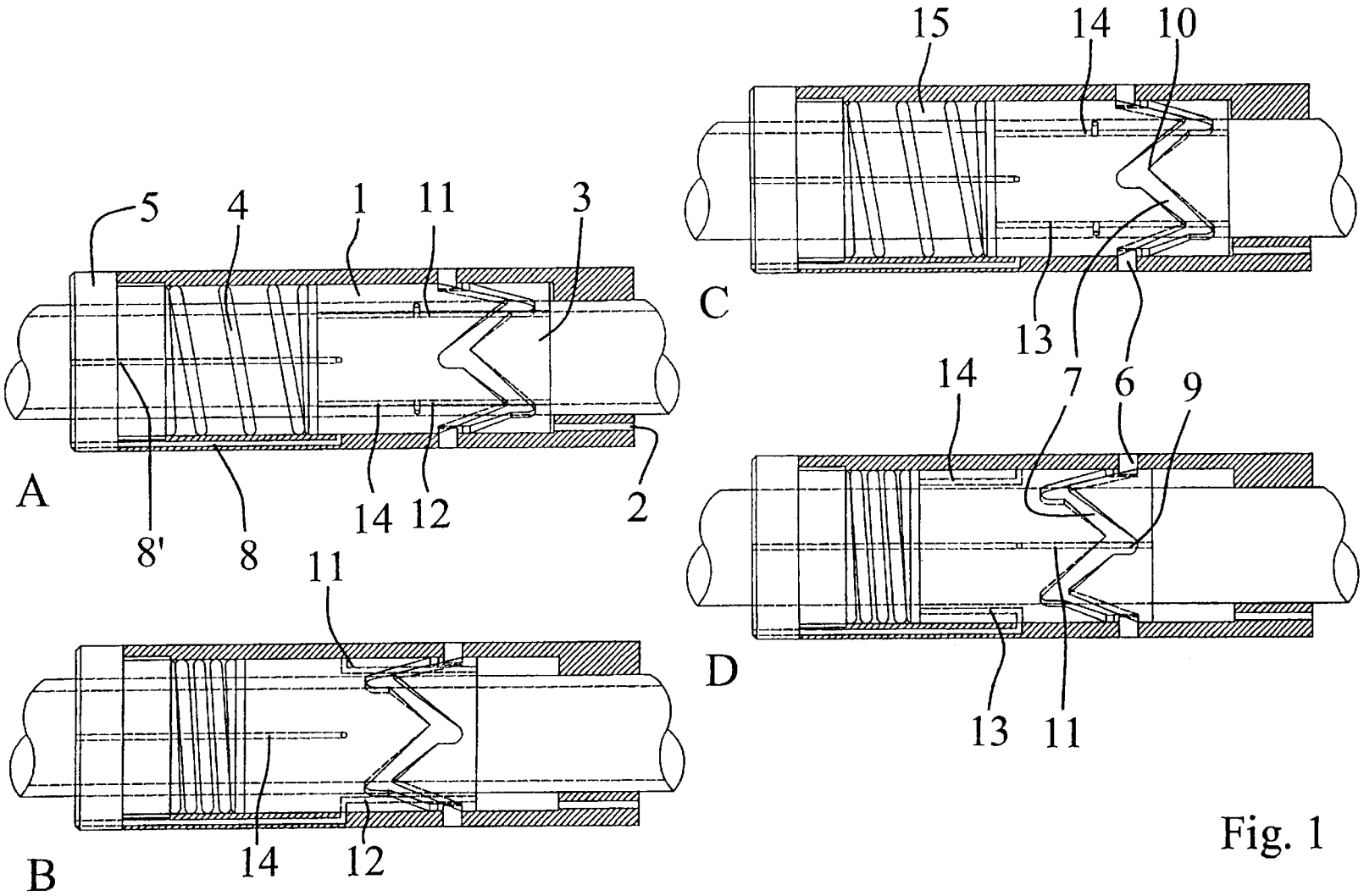
FIGS. 1A–D show various phases of a hollow, cylindrical, four-fluid switching

FIG. 1A illustrates a hollow, cylindrical, e.g. four-fluid-switching device 1 having a rotor 21, which is mounted in a holding cylinder 20, which is placed in a production tubing or string 22. With power supplied from one hydraulic line 2 to the rotor's 21 upper circular surface 3, the rotor 21 is pushed axially down towards a springing device 4 mounted between the rotor 21 and the holding cylinder's bottom seat or location 5.

The rotor's upper surface 3 and the cylinder 20 defines a pressure chamber 25, and the lower surface of the rotor 21 and the cylinder defines a return chamber wherein the springing device 4 is mounted.

Securely mounted on the holding cylinder's inner surface are two inwardly projecting guide lugs 6 spaced at 180° from each other or four at 90° apart. Round the rotor's 21 outer diameter there is cut out a 90° zigzag-shaped, wave-angled guide track 7, with a parking location 9 in each vertex 10, designed for control of the guide lugs 6.

In the lower edge of the holding cylinder there are provided two (or more) channels 8 and 8' spaced at 90° apart, which are open at a second end 8*b*,8'*b* in towards the rotor's 1 outer diameter, and at the other or first end 8*a*,8'*a* towards the bottom of the holding cylinder. In the rotor's 21 wall there are provided four channels 11,12,13,14 (or more) spaced at 90° apart; two of these, 11 and 12, are located spaced at 180° apart having a first end 11*a* and 12*a* respectively which communicates with the pressure chamber 25 and a second end 11*b* and 12*b* respectively which opens out in the rotor's 21 outer diameter immediately below the lower part of the rotor's guide track 7. Thereby fluid may flow from the pressure chamber 25 through the rotor from the first end 11, 12*a* of the channels 11, 12 respectively, i.e. the upper surface 3 of the rotor 21, down to the second end 11*b*, 12*b* of these channels.

The other two of these channels 13 and 14 are located spaced at 180° apart and with the possibility for fluid to flow through from the return chamber or spring housing's fluid volume 15 up to the device's outer diameter immediately below the device's guide track, i.e from the first ends 8*a*, 8'*a* of the channels 8, 8', to the second ends 8*b*8'*b* of the channels.

In the four-phase operation, for example, when the rotor 21 is exposed in phase B to a hydraulic downwardly pressing force on its upper circular surface 3, the rotor 21 will be forced by the guide lugs 6, which are engaged ith the four-part zigzag-shaped guide tracks 7, to travel from a vertex 10 to an adjacent vertex in a helical movement with its lower circular surface towards the spring device 4 which is gradually stressed. When the measured travel has been completed, the spring device 4 is under stress and the guide lugs 6 have been moved to the parking location 9, while at the same time the rotor 21 has successively completed a 45° turn. On account of this combined travel and rotation there will now be fluid communication between the hydraulic line 2 and the channel 8 via the channel 12. This now-established fluid communication is used, e.g., for controlling hydraulic tools connected to the output of channel 8 in the bottom of the cylinder's bottom location 5. Furthermore, there will now also be fluid communication between the channel 8' and the return chamber 15 via the channel 14. This now-established fluid communication is used, e.g., for venting return fluid from hydraulic tools connected to the output 8'*a* of channel 8' in the bottom of the cylinder's bottom location 5.

The next phase C is activated by relieving the hydraulic control pressure 2. The guide lugs 6 are thereby released from the parking location 9, and the now prestressed spring device 4 forces the rotor 21 up, while in the same way as in the first phase, the guide lugs 6 in engagement with the zigzag-shaped guide track 7 will force the rotor 21 to continue its helical travel in a new 45° to 90° in the same rotational direction. In this phase there will now be the same communication situation as in phase A, but there is no fluid communication between the hydraulic line 2 and the channel B. Nor is there any fluid communication between the channel 8' and the return chamber 15.

The third phase D is identical with the first, with the rotor 21 performing a newt downwardly helical movement but with renewed rotation from 90° to 135°.

On account of this combined travel and rotation of the rotor 21 there will now be fluid communication between the hydraulic line 2 and the channel 8' via the channel 11. This now-established fluid communication is used, e.g., for controlling hydraulic tools connected to the output or first end 8'*a* of channel 8' in the bottom of the cylinder's bottom location 5. Furthermore, there will now also be fluid communication between the channel 8 and the return chamber 15 via the channel 13. This now-established fluid communication is used, e.g., for venting return fluid from hydraulic tools connected to the output 8*a* of channel 8 in the bottom of the cylinder's bottom location 5.

The fourth phase (not shown) is identical with the stating position A, with the rotor 21 continuing the upwardly helical travel in a new 45° a with rotation to 180°.

A 180° rotation of the rotor 21 has therefore been implemented by means of pressure supply and pressure relief performed in succession. A similar, further operation may now be obtained by means of the channels 13 and 14 during a further rotation of the rotor 180° in similar steps of 45° to 360°.

Instead of four-part zigzag-shaped guide tracks 7, full rotation of the rotor 21 can be achieved by means of, e.g., three-part or six-part zigzag-shaped tracks, the deciding factor being the requirements and the practical constraints.

Figure 2:
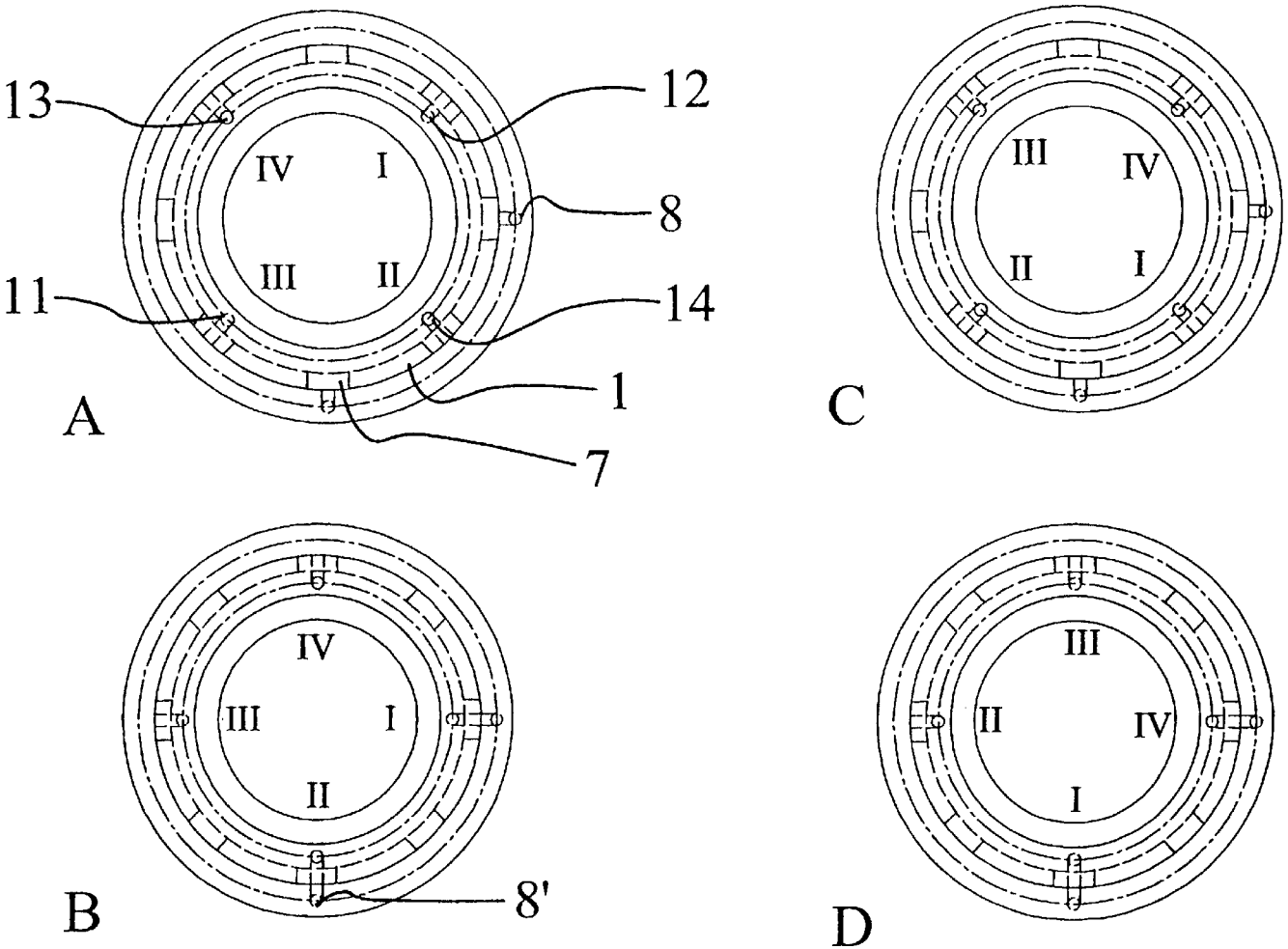
FIGS. 2A–D illustrate switching of the fluid streams with the device of FIGS. 1–D respectively.

FIG. 2 shows Eat switching of a fluid stream is implemented by permitting the hydraulic line's 2 power to pass a channel system 11, 12, 13 and 14 provided through the rotor 21, corresponding to one of the two fixed channel systems 8 and 8' in the cylinder 20, which systems pass the hydraulic power in sequence of rotation (I–IV) on to one of two different hydraulically operated units, such as admission valves or another fluid switch.

When, for example, an admission valve has been activated, and a shift to the next valve is implemented, at the same time with parallel use of existing channel systems sequentially, it is necessary to bleed the pressure from the first valve, which is carried out by a special filter screw directly into the production stream of oil/gas/condensate and/or water flowing through the hollow switch device.

Figure 3:
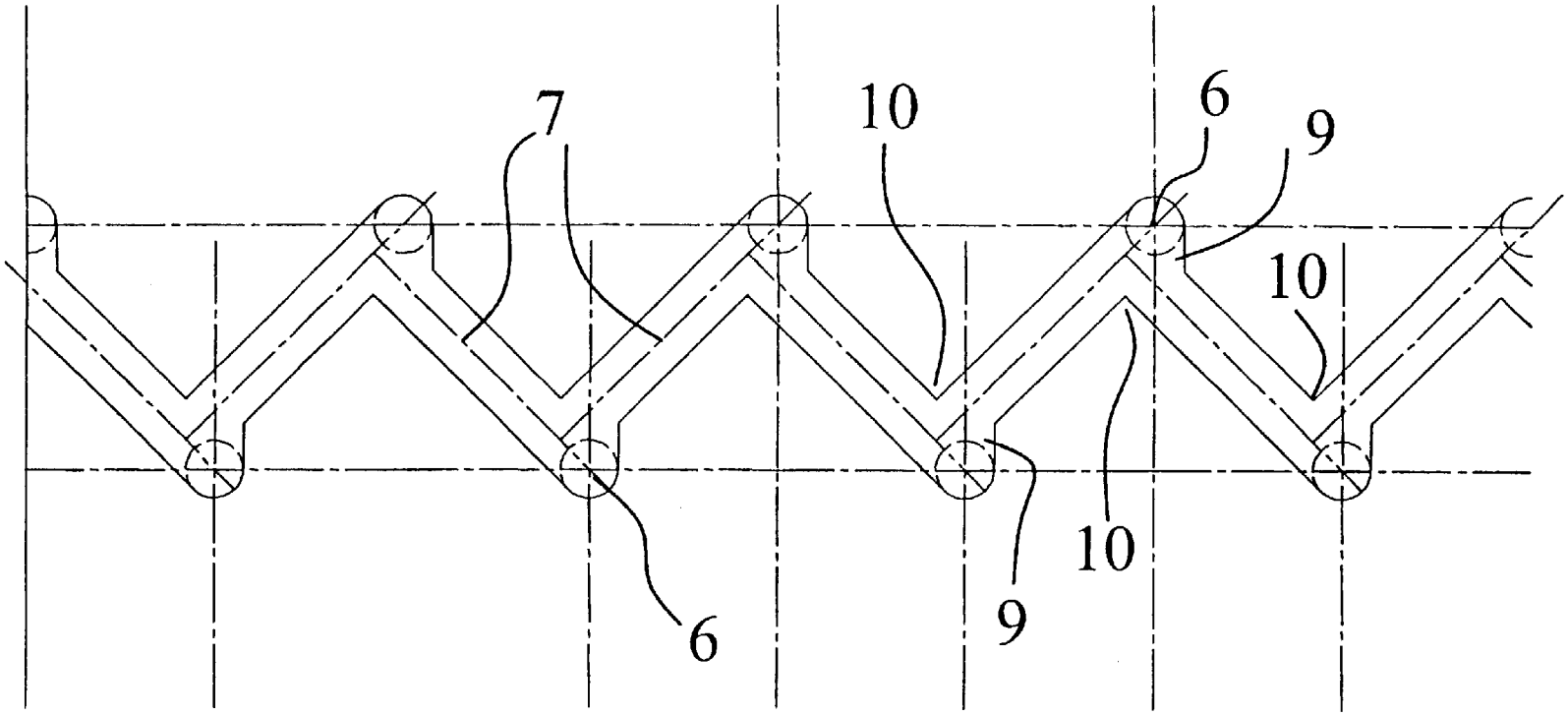
FIG. 3 illustrates a developed single-plane drawing of a guide track's angular waved shape.

FIG. 3 illustrates a developed single-plane drawing of a guide track's 7 angular waved shape; here illustrated with four 90° equally angled and identical waves calculated for four-part rotation of the rotor 21. A guide lug 6 is parked in each of the guide track's outer vertices 10, where a parking recess 9 ensures the guide lug's stability between each switch phase while fluid-switching operations are performed. When a new rotation is initiated by the supply or relief of pressure, the guide lug 6 slides axially and therefore unimpededly out of the parking location 9 and back into the guide track, whose vertices 10 always deviate from the axial centre line to such an extent tat the guide lug 6 forces the rotor 21 into one and the same rotational direction. The guide track's 7 angular shape with vertices 10 therefore permits one-way rotating travel, and only a step-by-step travel. If, for example, a switch change is desired from phase two to phase four, switching must be performed via phase three. Nor is it possible to switch back, for example, from phase three to phase two. In this case too switching must be performed from three to four to one to two.

The method also permits, for example, six-phase full rotation) which is achieved with six equiangular waves, each at 60°, or with six different angular waves, such as 90°+60°+45°+60°+60°+45°.

The sequence of rotation (I–IV) is adapted to the rotors 21 channel throughputs 11, 12, 13 and 14 in order to co-ordinate hydraulic power to respective hydraulically operated units 24.

The existing sequential correspondence between the rotor's 21 individual channels 11, 12, 13 and 14 and the cylinder's 20 fixed channels S and 8' for pressure transfer to various hydraulic tools simultaneously utilises the same channels individually for sequential corresponding transfer of the return oil stream for bleeding.

What is claimed:

1. A switch device for operation of hydraulic units arranged in a bore hole, especially for exploration of hydrocarbons from a formation in the ground, where the switch device is fastened to a string to be introduced into the bore hole, and the switch device and the hydraulic units being operable by a control pressure fluid supplied to the switch device, the switch device comprising:

a cylinder fastened to the string and having an inner surface;

a rotor coaxial with and rotatable in the cylinder, the rotor having an outer side surface in substantially fluid tight relation to the inner surface of the cylinder;

a pressure chamber defined by a first end of the rotor and the cylinder;

a return chamber defined by a second end of the rotor and the cylinder;

a return spring device mounted in the return chamber to exert a constant bias in a direction to move the rotor axially towards the pressure chamber, the pressure fluid introduced into the pressure chamber moving the rotor towards the return chamber when the force exerted by the pressure fluid against the rotor exceeds the biasing force of the spring device, and vice versa;

a track formed in the rotor and along its circumference; and a lug received in the track and fastened to the cylinder, the track comprising a plurality of successive track portions running in a circumferential direction of the rotor and also in opposite directions relative to the longitudinal direction of the rotor, in such a way that reciprocating movement of the rotor by a repeated supply of pressure fluid to the pressure chamber alternately with removal of pressure fluid from the pressure chamber brings about a one-way, stepwise rotation of the rotor relative to the cylinder, wherein:

a control pressure fluid line runs from the surface of the ground to the pressure chamber, the rotor further includes:

at least a first pair of channels comprising a first and a second channel, each having a first end communicating with the pressure chamber, and a second end opening through the outer side surface of the rotor at a first plane fixed relative to the rotor and lying transversely of the longitudinal axis of the rotor, and at least a second pair of channels comprising a third and a fourth channel, each with a first end communicating with the return chamber, and a second end opening through the outer side of the rotor surface at the first plane, and the cylinder further includes:

at least one pair of channels comprising a fifth channel and a sixth channel, each having first ends adapted to communicate with the hydraulic unit, and a second end opening through the inner surface of the cylinder at a second plane lying transversely of the longitudinal axis of the cylinder, whereby the reciprocating and step-wise movement of the rotor alternately causes the first and second planes to coincide with each other and to be spaced from each other, whereby a connection of the first or the second channel and the third or the fourth channel with the fifth or the sixth channel can be interrupted or established.

2. The switch device according to claim 1, wherein the first and the second channels and the third and the fourth channels, respectively, are mutually angularly displaced 180°, and the fifth and the sixth channels are angularly displaced 90° around the axes of the rotor and the cylinder, respectively.

* * * * *